United States Patent [19]

Ausmus, Jr.

[11] Patent Number: 4,630,686

[45] Date of Patent: Dec. 23, 1986

[54] EARTH SCRAPER FOR USE WITH A SMALL TRACTOR

[76] Inventor: Dee H. Ausmus, Jr., 2000 W. Taft, Sapulpa, Okla. 74066

[21] Appl. No.: 749,523

[22] Filed: Jun. 27, 1985

[51] Int. Cl.[4] ..... E02F 3/64; E02F 3/76

[52] U.S. Cl. ..... 172/393; 172/684.5

[58] Field of Search ..... 172/684.5, 799.5, 393, 172/387, 244, 701.1, 445.1, 482

[56] References Cited

U.S. PATENT DOCUMENTS

| | | | |
|---|---|---|---|
| 1,257,838 | 2/1918 | Frew | 172/684.5 |
| 1,373,799 | 4/1921 | Conley | 172/684.5 |
| 1,410,204 | 3/1922 | McCauley | 172/529 |
| 1,632,685 | 6/1927 | Welsh | 172/684.5 |
| 2,014,479 | 9/1935 | Martin | 172/799.5 |
| 2,552,426 | 5/1951 | Hedley | 172/393 |
| 2,795,060 | 6/1957 | Geiszler | 172/684.5 |

FOREIGN PATENT DOCUMENTS

| | | | |
|---|---|---|---|
| 239263 | 6/1962 | Australia | 172/684.5 |

*Primary Examiner*—Richard J. Johnson

*Attorney, Agent, or Firm*—Head, Johnson & Stevenson

[57] ABSTRACT

An earth scraper for use with a small tractor having a draw bar, the scraper being formed of a generally horizontal frame, the forward end being attachable to a ball hitch or the like on the draw bar of a tractor, the frame supporting an elongated blade of semi-circular, cross-sectional configuration providing a concave forward surface and a convex rearward surface, the top edge of the blades being pivotally secured to the frame and the bottom edge forming a scraping edge, skids affixed to each end of the blade extending in a vertical plane perpendicular the blade longitudinal axis, each skid having an arcuate forward end and an elongated flat bottom surface which is slightly elevationally above the blade scraping edge, and a lever for rotationally adjusting the blade relative to the frame.

2 Claims, 4 Drawing Figures

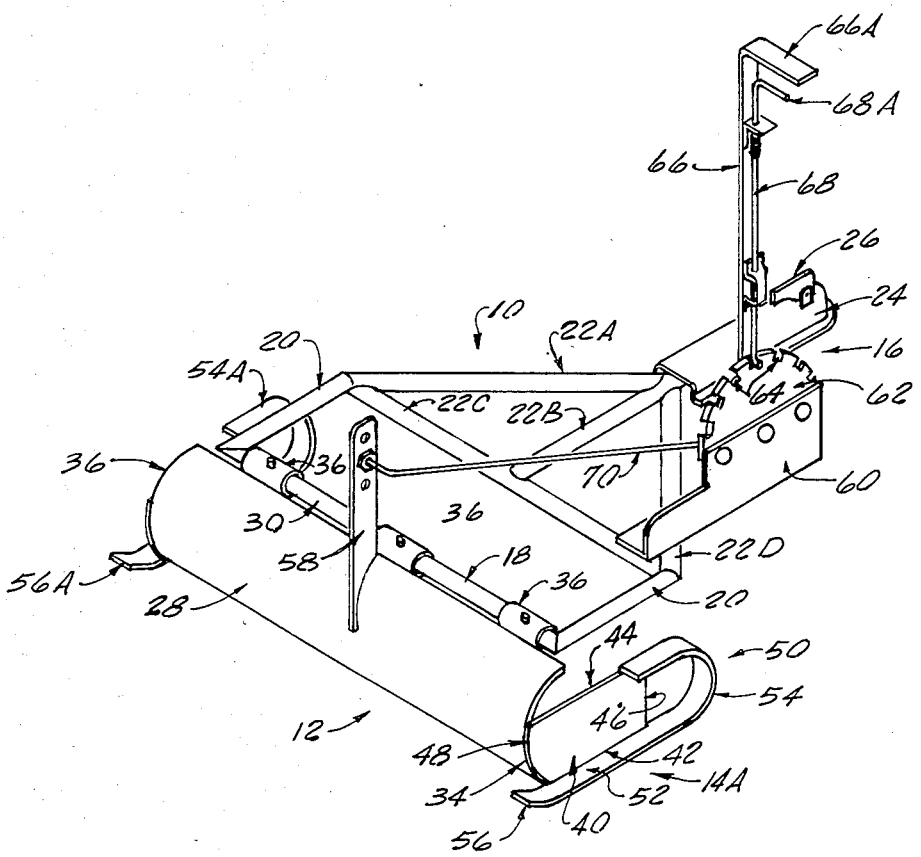
FIG. #1
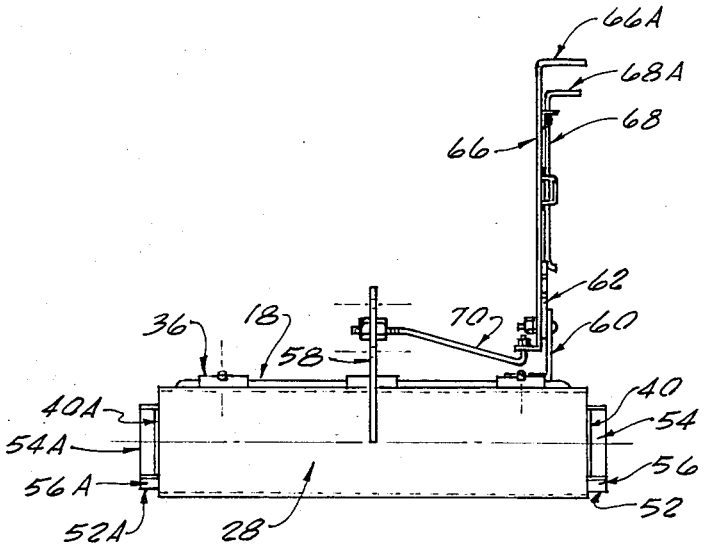
FIG #2

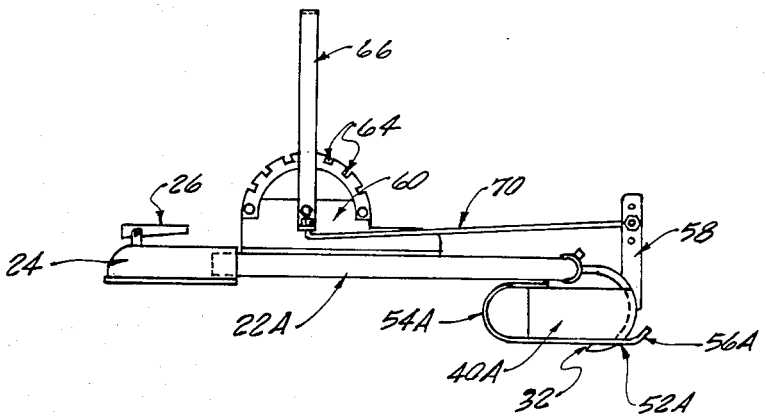
FIG. #3
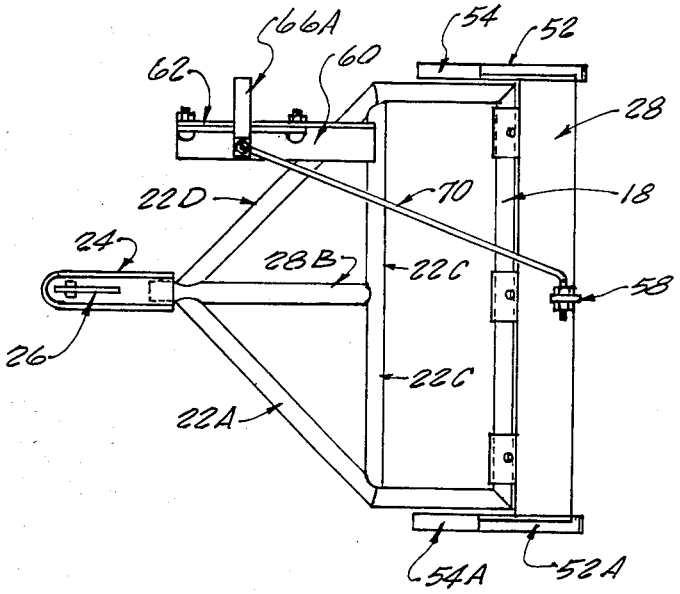
FIG. #4

EARTH SCRAPER FOR USE WITH A SMALL TRACTOR

SUMMARY OF THE INVENTION

The use of earth scraping equipment is well known and such equipment varies in size and capacity from large earth moving apparatus as used in constructing dams, highways and the like, down to scrapers used on farm size tractors for terracing, yard work and the like. While the use of scrapers for moving and contouring earth has proven very successful in sizes from farm tractors up, the equipment available for use by small, garden or lawn mower type tractors has not been as successful. Because of the relatively light weight of garden and lawn mower tractors and their relatively small horse power, scrapers which have been designed in the past have not been successful. While scraper blades have been used such as for moving snow by means of small garden-type and lawn mower tractors, the use of the same equipment cannot be employd to move and contour the earth's surface.

A serious problem with the existing type of scrapers is that they do not provide means for accurately controlling the penetration of a blade into the earth so as to keep the drag of the blade within the limits permitted by the relatively low motive force which can be obtained from a small garden or lawn mower-type tractor. A variation of a fraction of an inch in the amount of penetration of a scraper blade into the earth will substantially change the amount of horse power required to move the blade through the earth. The existing type of scrapers have not been successful in accurately controlling the penetration of scraper blades.

The present invention is directed toward a scraper specifically designed for use with light weight, low horse power tractors such as the type commonly available for mowing lawns and for tilling gardens. Many home owners have small riding tractors which could be used for moving and contouring yard surfaces if the equipment does not impose a drag load which exceeds the capacity of such small tractors. The present invention achieves this result by providing a frame having means at the forward end thereof for attachment to a tractor, such as by a ball hitch. At the rear end of the frame an elongated blade of semi-circular cross-sectional configuration is attached. The blade is shaped and can be successfully constructed, of a pipe cut half in two in a plane of the pipe's cylindrical axis. The upper edge of the semicircular cross-section blade is pivoted to the rear of the frame. The lower edge forms a scraping edge.

Affixed to each end of the blade is a skid formed of a flat piece of metal. Each of the skids has an arcuate forward end and an elongated flat bottom surface. The bottom surface is slightly elevationally above the blade bottom edge, such as about three-fourths of an inch. By means of a lever pivoted to the frame and a rod extending from the lever to an arm which attaches at its lower end to the blade, the angle of pivotation of the blade relative to the horizontal frame is adjustable so that the blade can be lowered to scrape a thin layer of earth, such as about three-fourths of an inch thick or the blade can be raised to dump the earth accumulated in front of the semi-circular, cross-section blade A better understanding of the invention will be had with reference to the following description and claims, taken in conjunction with the drawings.

DESCRIPTION OF THE DRAWING

FIG. 1 is an isometric view of an earth scraper for use with a small tractor according to this invention.

FIG. 2 is a rear elevational view of the scraper of FIG. 1.

FIG. 3 is a side elevational view of the scraper of FIG. 1.

FIG. 4 is a top plan view of the scraper of FIG. 1.

DETAILED DESCRIPTION OF THE PREFERRED EMBODIMENT

Referring to the drawing and first to FIG. 1, the earth scraper of this invention includes the basic elements of a generally horizontal frame indicated generally by the numeral 10, an elongated semi-circular, cross-sectional blade indicated generally by the numeral 12, skids affixed to each end of the blade, generally indicated by the numerals 14A and 14B, and means to rotationally adjust the blade relative to the frame generally indicated by the numeral 16. These basic portions of the device will be now described in greater detail. The frame 10 is formed of structural members welded or bolted together and includes a horizontal rearward end member 18, side members 20 and an A-shaped tongue portion formed of members 22A–22D. Affixed to the forward end of the tongue portion 22A–22D is a hitch 24 of the type typically employed by which a trailer is hitched to a ball, the ball not being shown, but which would typically be on the craw bar of a small tractor. The hitch 24 includes a lever 26 used to lock the hitch on to or remove it from a ball.

The blade portion 12 includes an elongated blade element 28 which in cross-section, as seen in the end view of FIG. 3, is semi-circular. Blade 28, may be cut from a length of pipe, includes a top edge 30, a bottom edge 32 which also forms a scraping edge and which, therefore, is preferably formed to a sharp edge and ends 34 and 36. The top edge 30 is pivoted to the frame rearward end member 18 which can be accomplished by small length tubular members 36 rotatably received on the end member 18 and welded to the blade upper edge 30.

The first skid 14A is affixed to blade end 34. This is accomplished by means of a vertical plate 40 having a bottom edge 42, a top edge 44, a front edge 46 and rearward edge 48. The rear edge 48 is welded to the blade first end 34 and when the blade is rotationally oriented such that the bottom and top edges 30 and 32 are in approximate vertical alignment, the plate bottom edge 42 is horizontal.

A runner is affixed to plate 40, the runner being typically formed of an elongated flat piece of metal, rectangular in cross-section, bent to the shape illustrated in which the runner generally indicated by a number 50, has a horizontal portion 52 welded to the plate bottom edge 42. The forward end of the runner is U-shaped at 54 to provide a portion which is bent back and welded to the top edge 44 of plate 40. Extending in the opposite direction from the runner portion 52 is an upwardly tilted portion 56 which extends rearwardly of blade 28.

The plate 40 and runner 50 affixed to the blade first end 34 have been described and the plate and runner affixed to the blade second end 36 is the same, the elements thereof being given the same number except for the addition of the letter A to the portions affixed to the blade second end 36.

The blade rotational adjustment means will now be described. Affixed to blade 28, at its rearward or convex surface 28, is an upstanding arm 58. Affixed to the frame tongue portion is a support bracket 60 and to it, a vertically extending ratchet plate 62. A series of notches 64 are provided in the semi-circular upper edge of the ratchet plate.

The lower end of a lever 66 is pivotally attached to the bracket 60 at the center of the semi-circular plate 62. A release bar 68 is slidably received on the side of lever 66, the lower end of which extends in one of the notches 64 on plate 62. The release bar has a curved upper portion 68A conforming to and placed below the curved upper portion 66A of the lever. By upward pull on the portion 68A of the release bar the lower end is removed from engagement with a notch 64 permitting lever 66 to be pivoted. Attached to the lower end of the lever, below the pivot point, is a rod 70 which also attaches to the upper portion of arm 58. By the pivotation of lever 60 the annular position of blade 28 relative to the frame can be adjusted.

OPERATION

To use the earth scraper to scrap a quantity of earth the device is hitched to a small tractor. The small tractor of the type utilized by gardeners and for mowing lawns is sufficiently small so that the seat of the operator is adjacent the rear end of the tractor and the operator can, without moving from the seat of the tractor, reach back to the lever portion 66A and the release bar portion 68A so that the angular position of the lever 66 can be adjusted without the operator moving from the tractor.

When the blade 28 is rotationally adjusted so that the runners 52 and 52A are horizontal, a small portion of the blade lower edge 32 extends below the runners. This can be approximately ¾ of an inch and can not be too great otherwise the blade will tend to dig up earth too rapidly as it is pulled meaning that the horsepower requirement of the typical garden or lawn mowing type tractor would be exceeded. As the scraper is pulled earth accumulates within the concave forward surface of the blades between the end plates 40 and 40A. When sufficient earth has been accumulated and the user wants to move the earth, that is, slide it along the surface of the ground, to a remote location, without further scraping, the lever 68 can be pivoted forwardly, pivoting the blade, as viewed in the end view of FIG. 3, clockwise. This will move the blade lower edge 32 up to ground level as the earth scraper is supported on the runner upwardly tilted portions 56. With the scraper in this position the earth which has been scraped and accumulated forwardly of the blade is held trapped in the blade and the scraped earth can be moved to another location.

When the operator reaches a location where he desires to dump the earth which has been accumulated, lever 66 is pivoted rearwardly, tilting the runners onto the U-shaped forwarded portions 54 and 54A, raising the blade lower edge 32 off the ground allowing the dirt to dump out. After the dirt has been dumped, the operator can maintain the scraper in the same position so that he cam pull the scraper over the earth without the scraping edge 32 engaging the earth until he reaches the location where additional scraping action is to take place. When ready for additional scraping, the operator positions the lever to that such as shown in FIG. 1, wherein the runners 52 and 52A are horizontal. The operation can be repeated as necessary to scrape up and move earth as desired.

The scraper of this invention thus provides a device which is particularly adaptable for use with a small size garden type or lawn mower type riding tractor having limited horsepower and traction. The scraper provides controls enabling the operator to carefully control the amount of scraping so as not to exceed the limited horsepower and traction available, but which permits the operator to use the scraper in an expeditious way to level ground or to move earth from one location to another.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An earth scraper for use with a small tractor having a hitch comprising:

a generally horizontal frame having a forward end and a rearward end, the forward end having means for removable attachment to a hitch of a tractor;

an elongated blade of semi-circular, cross-sectional configuration taken perpendicular the longitudinal axis thereof providing a concave forward surface and a convex rearward surface, opposed ends, and a top and bottom edge, the top edge being pivotally secured to said frame rearward end, the bottom edge forming a scraping edge;

a first and a second vertical skid plate, each skid plate having a rearward end, a forward end, a top edge and a bottom edge, the rearward edge of the first skid plate being affixed to one end of said blade and the rearward edge of the second skid plate being affixed to the other end of said blade, the top and bottom edges of both plates being perpendicular to the plane of said blade longitudinal axis, and the lower edge of both skid plates being above said bottom edge of said blade; and a first runner formed of an elongated flat piece of metal attached to said first skid plate lower edge and extending forwardly of said first skid plate forward edge in an arcuate configuration and one end of the first runner being attached to said skid plate upper edge, the other end of the runner extending rearwardly of said blade;

a second runner configured as said first runner and being attached to said second skid plate; and means to rotationally adjust said blade relative to said frame.

2. The earth scraper according to claim 1 wherein means to rotationally adjust said blade relative to said frame includes:

a vertical ratchet plate affixed to said frame having a plurality of stop positions thereon;

a lever pivotally secured to said ratchet plate;

releasable means for non-rotatably locking said lever at one of said stop positions;

an arm affixed to said blade and extending generally uprightly;

a rod extending from said lever to said arm whereby the position of said lever controls the rotatable position of said blade relative to said frame.

* * * * *